United States Patent [19]

Woods

[11] Patent Number: 4,770,304

[45] Date of Patent: Sep. 13, 1988

[54] MOBILE ENGINE HOIST AND REBUILD STAND ASSEMBLY

[75] Inventor: Terry W. Woods, Bakersfield, Calif.

[73] Assignee: Andrew D. Lewis, Bakersfield, Calif.; a part interest

[21] Appl. No.: 46,125

[22] Filed: May 5, 1987

[51] Int. Cl.[4] ..... B66C 23/78

[52] U.S. Cl. ..... 212/140; 212/189; 212/195; 212/267

[58] Field of Search ..... 212/203, 244, 254, 265, 212/264, 140, 267, 234, 230, 195, 189; 414/560, 561

[56] References Cited

U.S. PATENT DOCUMENTS

| | | | |
|---|---|---|---|
| D. 184,343 | 2/1959 | Durbin et al. . | |
| 1,614,697 | 1/1927 | Snook . | |
| 2,859,881 | 11/1958 | Coryell . | |
| 2,974,809 | 3/1961 | Sellars et al. | 212/203 |
| 2,976,033 | 3/1961 | Martin . | |
| 3,275,296 | 9/1966 | Meyer | 212/265 |
| 4,029,308 | 6/1977 | Mathers . | |
| 4,099,634 | 7/1978 | McIntyre | 212/203 |
| 4,239,196 | 12/1980 | Hanger . | |
| 4,508,233 | 4/1985 | Helms | 212/265 |
| 4,597,498 | 7/1986 | Spinosa et al. | 212/254 |

*Primary Examiner*—Joseph F. Peters, Jr.
*Assistant Examiner*—Stephen P. Avila
*Attorney, Agent, or Firm*—Fleit, Jacobson, Cohn & Price

[57] ABSTRACT

An engine hoist and rebuild stand assembly is provided including an upright standard and an inclined boom removably supported from the upper end of the standard. The boom includes a lengthwise extendable load lifting end provided with a guide pulley over which an elongated flexible tension member may be passed and the end of the tension member which passes over the guide pulley is operatively connected to winding and unwinding structure carried by the non-extendable end of the boom. Further, the standard includes a horizontal transvers base outwardly from which a pair of generally parallel leg assemblies project in generally the same direction from which the extendable end of the boom projects from the standard and a mid-height portion of the standard includes a mount supported therefrom for selectively angular displacement about a horizontal axis generally paralleling the leg assemblies and from which mount the bell housing end of an engine may be securely mounted.

9 Claims, 2 Drawing Sheets

MOBILE ENGINE HOIST AND REBUILD STAND ASSEMBLY

BACKGROUND OF THE INVENTION

1. Field of the Invention

This invention relates to an engine hoist and rebuild stand assembly for lifting an automotive engine from the engine compartment of an associated vehicle, for supporting the removed engine in a mobile manner for movement around a shop or engine repair area and for supporting the engine from one crankshaft end thereof for adjusted angular displacement about a horizontal axis generally paralleling the crankshaft of the engine. Further, the assembly is constructed in a manner whereby various of the major components thereof may be disassembled for compact storage and shipment.

2. Description of Related Art

Various different forms of engine hoists and motor stand assemblies heretofore have been provided such as those disclosed in U.S. Pat. Nos. 1,614,697, 2,859,881, 2,976,033, 4,029,308, 4,239,196 and D-184,343. However, these previously known devices do not include the overall structural combination of the instant invention and are not operative to perform all of the functions which may be readily performed by the instant engine hoist and rebuild stand assembly.

SUMMARY OF THE INVENTION

The hoist and stand assembly of the instant invention includes some of the general structural features of a conventional engine hoist, but is constructed in a manner whereby an engine removed from a vehicle thereafter may be supported from the assembly in an advantageous manner for performing engine rebuild operations thereon and with little interference by various components of the assembly to movement of a mechanic around the engine being rebuilt. In this regard, after an engine has been removed from an engine compartment by the assembly and has been mounted from the assembly for rebuild operations, the entire boom assembly of the hoist may be removed in order to facilitate easy access to the various engine components upon which rebuilding work must be performed. Further, the engine may be mounted from the assembly for rebuilding operations in a manner supporting the engine from the assembly for adjusted angular displacement about a horizontal axis generally paralleling the crankshaft of the supported engine.

The main object of this invention is to provide an engine hoist assembly for removing automotive engines from engine compartments and which may also be used to support the engine in an advantageous manner for performing engine rebuild operations thereon.

Another object of this invention is to provide an engine hoist assembly including a boom which may be removed subsequent to securement of an engine from the standard position of the hoist assembly for rebuilding operations.

Still another important object of this invention is to provide an engine hoist and rebuild stand assembly which is fully mobile.

A further object of this invention is to provide an engine hoist and stand assembly including readily disengageable major components whereby the assembly may be stored and shipped in a compact state.

A final object of this invention to be specifically enumerated herein is to provide a combined engine hoist and rebuild stand assembly in accordance with the preceding objects and which will conform to conventional forms of manufacture, be of simple construction and easy to use so as to provide a device that will be economically feasible, long lasting and relatively trouble free in operation.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENT

Figure 1:
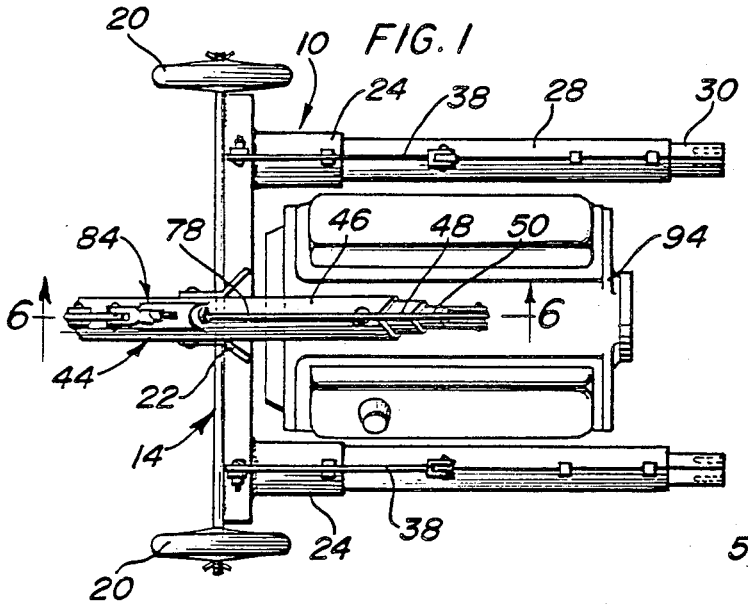
FIG. 1 is a top plan view of the assembly of the instant invention illustrated in operation supporting an engine therefrom in a manner enabling the engine to be raised or lowered relative to the assembly.

Referring now more specifically to the drawings, the numeral 10 generally designates a combined mobile engine hoist and rebuild stand assembly comprising the instant invention. The assembly 10 includes an upright tubular standard 12 and a base assembly referred to in general by the reference numeral 14 from which the lower end of the standard 12 is supported.

The base assembly 14 includes an elongated horizontal transverse tubular base member 16 from whose opposite ends a pair of stub axles 18 are supported. A pair of wheels 20 are journalled from the stub axles 18 and the central portion of the base member 16 includes a gusset braced mounting bracket 22 from which the lower end of the standard 12 is removably supported through the utilization of suitable fasteners (not shown). The base member additionally includes a pair of horizontally laterally outwardly projecting square tubular members 24 adjacent the opposite ends of the base member 16 and which project forwardly therefrom.

A leg assembly referred to in general by the reference numeral 26 is removably supported from each tubular member 24 and each leg assembly 26 incorporates a tubular base section 28 and a tubular extension section 30 telescopingly engaged in one end of the corresponding base section 28. The other end of each base section 28 is telescoped into the corresponding tubular member 24 and secured in position therein through the utilization of a pair of set screws 32. In addition, each base section 28 includes a pair of longitudinally spaced set screws 34 by which the corresponding extension section 30 may be secured in adjusted extended position, the outer end of each extension section 30 including a caster wheel assembly 36. Further, a pair of inclined braces 38 are provided and have one pair of corresponding ends pivotally mounted to mounting brackets carried by the opposite ends of the base member 16 as at 40. The other pair of ends of the braces 38 are removably anchored relative to upstanding flanges 42 carried by the corresponding base sections 28.

An elongated boom assembly is referred to in general by the reference numeral 44 and includes a tubular base section 46 and first and second extension sections 48 and 50 slidingly telescopingly engaged with the sections 46 and 48, respectively. The section 46 includes a set screw 52 for retaining the section 48 in adjusted extended positions and the section 48 includes a set screw 54 for securing the section 50 in adjusted shifted position. Also, the sections 48 and 50 include abuttments 56 and 58 thereon which are engageable with the set screws 52 and 54, when loosened, in order to prevent disengagement of the sections 48 and 50 from the sections 46 and 48, respectively.

Figure 6:
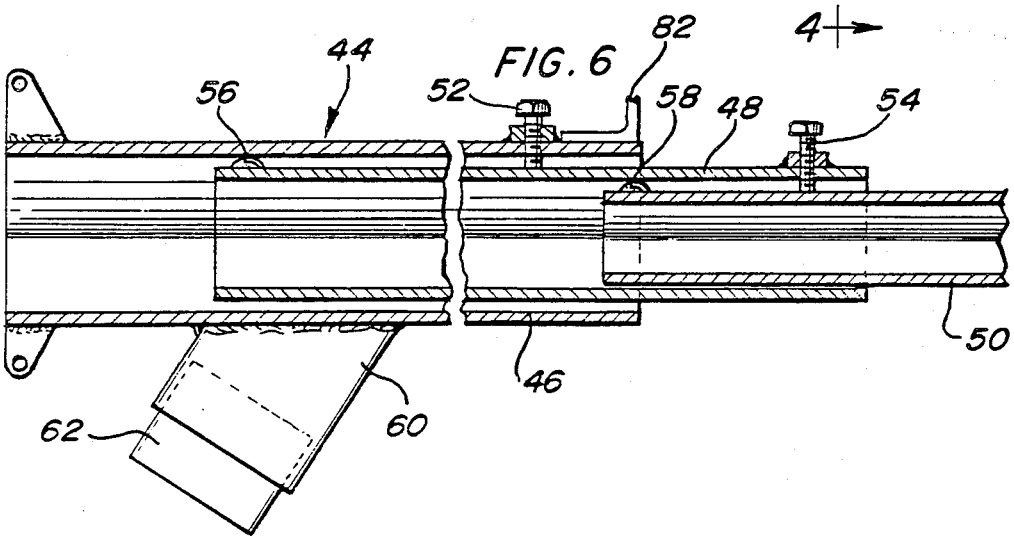
FIG. 6 is an enlarged fragmentary longitudinal vertical sectional view taken substantially upon the plane indicated by the section line 6—6 of FIG. 1 and with intermediate length portions of the boom being broken away.

From FIG. 6 of the drawings, it may be seen that the section 46 includes an angled depending, tubular mounting shank 60 in whose lower end a tubular projection 62 is secured. The tubular section 62 is snugly telescopingly downwardly receivable within the upper end of the tubular standard 12 and the latter includes a set screw 64 for releasably retaining the projecting portion of the tubular projection 62 within the upper end of the standard 12. Thus, as may be seen from FIG. 2 of the drawings, the boom assembly 44 is removably supported atop the upper end of the standard 12 in inclined position with the section 50 uppermost. In addition, an inclined brace 66 extends between and is removably anchored to the standard 12 as at 68 and the end of the section 46 remote from the section 50 as at 70.

Figure 4:
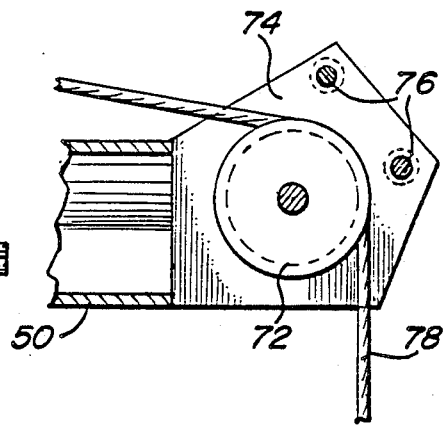
FIG. 4 is a fragmentary vertical sectional view taken substantially upon the plane indicated by the section line 4—4 of FIG. 3.
Figure 3:
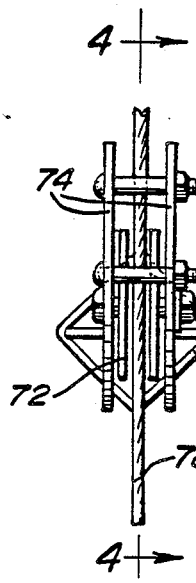
FIG. 3 is an end elevational view of the free end of the boom portion of the assembly.
Figure 2:
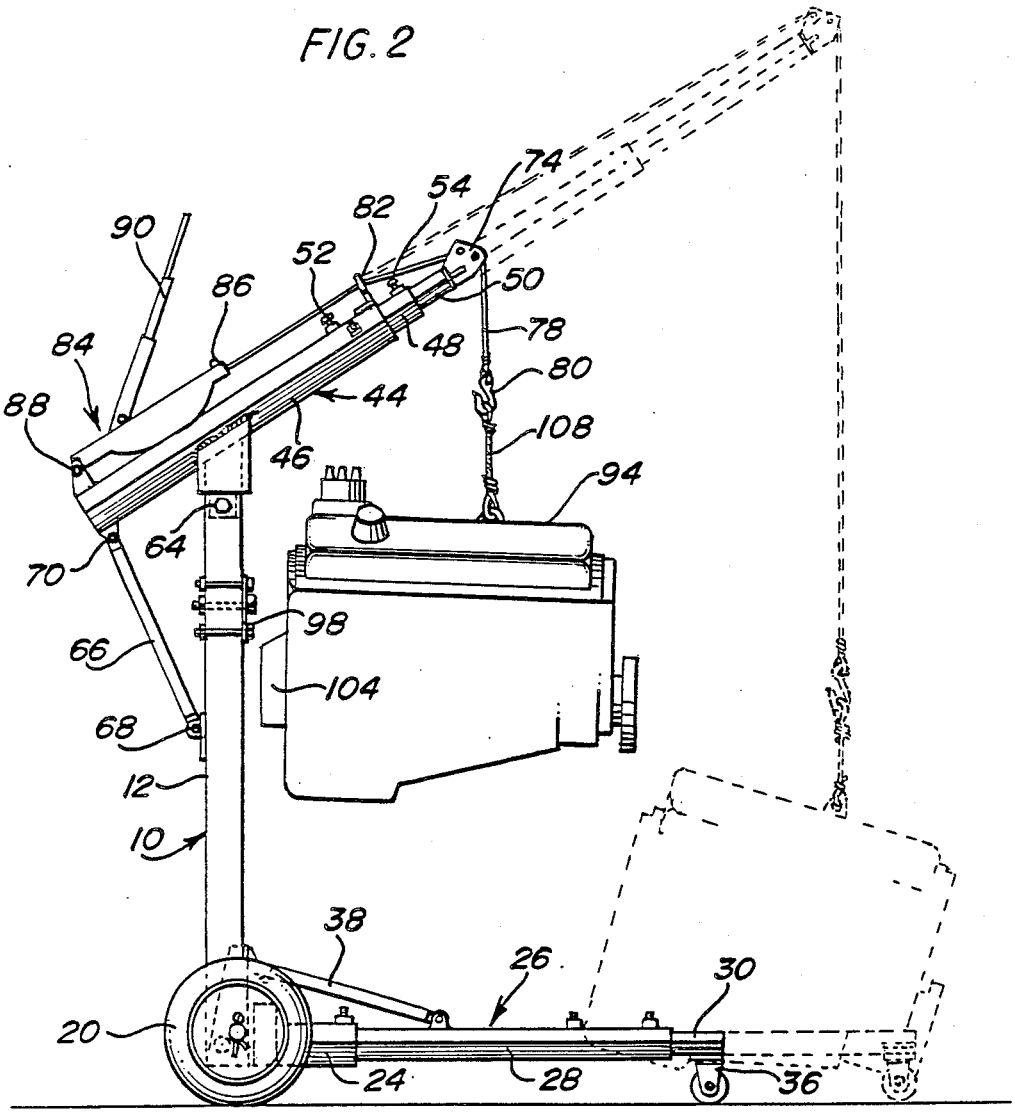
FIG. 2 is an enlarged side elevational view of the assemblage illustrated in FIG. 1 and with extended positions of the boom and legs of the assembly illustrated in phantom lines.

With attention now invited more specifically to FIGS. 2 and 4 of the drawings, it may be seen that a guide pulley 72 is journalled between a pair of opposite side plates 74 carried by the outer end of the section 50 and that a pair of transverse bolts 76 extend between and relatively stabilize the free end portions of the plates 74.

An elongated flexible tension member 78 is trained over the guide pulley 72 and one end portion of the tension member 78 depends downwardly from the guide pulley 72 and is equipped with suitable anchor structure such as a hook 80. The other end of the tension member 78 also passes over an upwardly projecting stationary guide 82 carried by the uppermost end of the section 46 and is thereafter operably connected to a reeling and winding structure such as a lever actuated come-along referred to in general by the reference numeral 84 and removably supported from the boom assembly 44 as at 86 and 88. The come-along 84 may be of any conventional type wherein the lever portion 90 thereof includes a reversable ratchet drive (not shown) with a winding drum (not shown) about which the end of the tension member 78 remote from the hook is partially wound. Accordingly, the come-along 84 may be utilized to raise and lower the load represented by the automotive engine 94 illustrated in FIGS. 1 and 2.

Figure 5:
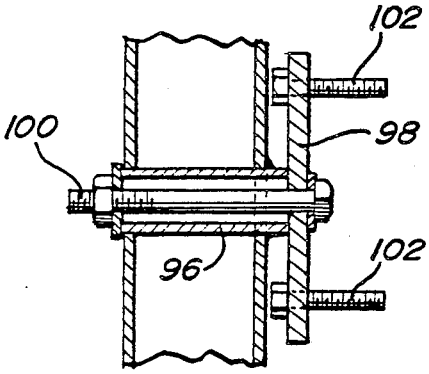
FIG. 5 is an enlarged fragmentary vertical sectional view of the rotatable engine block mount carried by the standard of the assembly.

With attention now invited more specifically to FIGS. 2 and 5, an intermediate height portion of the standard 12 has a mounting sleeve 96 secured therethrough and a mounting plate 98 is rotatably mounted from the sleeve 96 through the utilization of a pivot bolt 100 secured through the mounting plate 98 and the sleeve 96. The sleeve 96 projects forwardly of the front side of the standard 12 and thereby maintains the mounting plate 98 in spaced relation relative to the front side of the standard 12. Further, the mounting plate 98 includes four bolts 102 passed therethrough from the rear side thereof and each of the bolts 102 may be utilized to mount an apertured or slotted adapter finger or arm (not shown) to the mounting plate 98. Such fingers or arms are well known in the motor stand art and may be pivotally and slidably adjusted to align appropriate mounting apertures formed therein with threaded bores formed in the bell housing 104 of the engine 94.

In operation, when it is desired to lift an engine from an automobile engine compartment, the sections 48 and 50 are extended and secured in extended positions by the set screws 52 and 54. Then, a short length of cable or chain 108 is attached to a suitable central part of the engine 94 and the other end is anchored relative to the hook 80. Thereafter, the come-along 84 may be used to lift the engine 94 out of the vehicle engine compartment. During this lifting operation, the extension sections 30 of the leg structures 28 will be maintained in the extended positions thereof.

After the engine 94 has been lifted out of the associated vehicle engine compartment, the assembly 10 is rolled back away from the associated vehicle and the come-along 84 is actuated to lower the engine 94 to the surface upon which the assembly 10 rests. Then, the extension sections 30 may be retracted and the sections 50 and 48 also may be retracted. Then, the engine 94 is again raised to and slightly beyond the position thereof illustrated in FIG. 2 of the drawings through utilization of the come-along 84 and then biased rearwardly until the bell housing 104 contacts and engages the fingers (not shown) mounted to the mounting plate 98 by the bolts 102. Suitable bolts may then be secured through the fingers and threadedly engaged and tightened within the threaded bores (not shown) in the bell housing 104. Then, the bolts 102 may be tightened thus securing the engine 94 to the mounting plate 98. Thereafter, the hook 80 may be disengaged and the engine 94 may be rotated about the horizontal pivot axis defined by the bolt 100 to any desired position for working upon the engine. Further, by disconnecting the inclined brace 66 at 70 and loosening the set screw 64 the entire boom assembly 44 may be removed, thus enabling a mechanic full access to all parts of the engine 94. Of course, when the engine has been repaired, it may be reinstalled in the associated vehicle by reversal of the above-noted steps.

Figure 7:
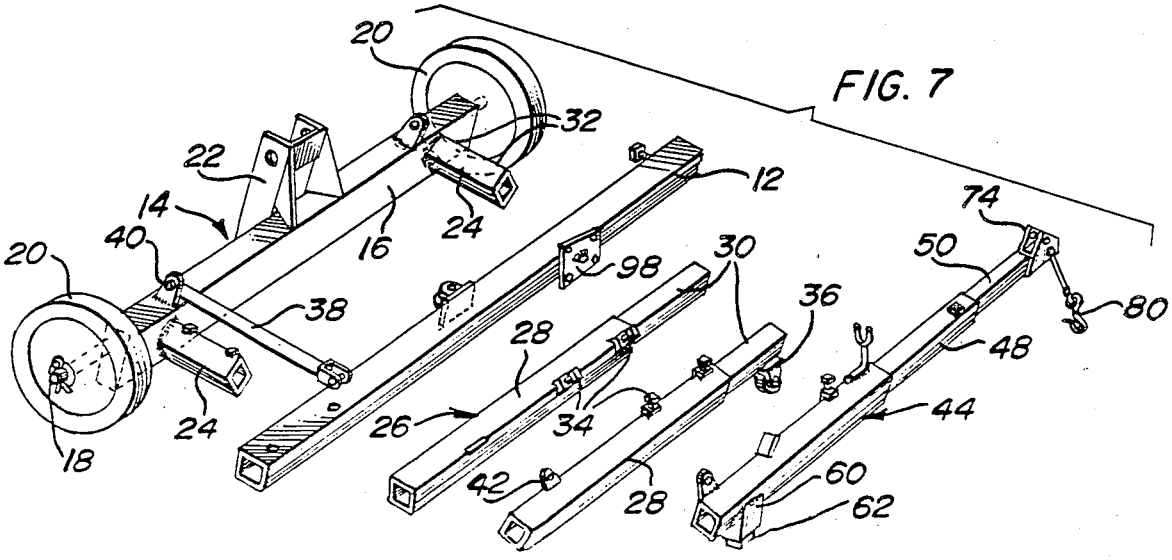
FIG. 7 is an exploded perspective view of a majority of the components of the engine hoist and rebuild stand assembly of the instant invention.

From FIG. 7 of the drawings it may be seen that the assembly 10 may be conveniently stored or shipped in a compact state. Further, it is believed that it will be appreciated the assembly 10 may be inexpensively constructed of readily available components. If it is desired, however, a relatively light weight winch may be added to the boom assembly 44 in lieu of the come-along 84.

The foregoing is considered as illustrative only of the principles of the invention. Further, since numerous modifications and changes will readily occur to those skilled in the art, it is not desired to limit the invention to the exact construction and operation shown and described, and, accordingly, all suitable modifications and equivalents may be resorted to, falling within the scope of the invention.

What is claimed as new is as follows:

1. A mobile engine hoist and rebuild stand assembly, said assembly including an upright standard having upper and lower ends, base means carried by said lower end for support of said standard from a support surface disposed therebeneath, an elongated boom having base and free end portions and removably supported from the upper end of said standard with at least said free end portion projecting outwardly of one side of said standard, said free end portion being supported from said base end portion for adjusted longitudinal extension and retraction relative to said base end portion, an elongated, flexible load lifting tension member having first and second ends and a mid-portion disposed between and connecting said first and second ends, winding and unwinding means mounted on said boom base end portion and with which said first end is operatively connected for winding thereon and unwinding therefrom, guide means carried by said free end portion guidingly engaging said mid-portion and allowing said second end to depend downwardly therefrom, means carried by said second end portion for engagement with a load to be lifted, said base end portion of said boom projecting outwardly from a second side of said standard opposite said one side, and inclined brace means releasably connected between said standard at a point thereon below said boom and the terminal end of said base end portion.

2. The assembly of claim 1 wherein said one side of said standard includes engine block mounting means thereon spaced below said boom and against which the bell housing end of an automotive engine block may be biased for bolting thereto when said free end portion of said boom is retracted relative to said base end portion and said engine block is elevated by said tension member to a position closely spaced below said boom, said mounting means being supported from said one side of said standard for adjusted angular displacement relative to said standard about a horizontal axis disposed generally normal to said one side.

3. The assembly of claim 1 wherein said base end portion of said boom includes an intermediate length portion having support shank means depending therefrom removably telescopingly engaged with the upper end of said standard.

4. The assembly of claim 3 wherein said boom is inclined with said free end disposed uppermost.

5. The assembly of claim 1 wherein said base means includes an elongated horizontal transverse base member from which the lower end of said standard is supported intermediate the opposite ends of said transverse base member, the opposite end portions of said base member including elongated laterally outwardly projecting leg members having inner ends mounted from said base member and outer end portions extending outward of the same side of said base member in the same general direction in which said one side of said standard faces, the opposite ends of said base member and the outer end portions of said leg members including support members mounted therefrom for support from said surface.

6. The assembly of claim 5 wherein said support members comprise support wheels.

7. The assembly of claim 5 wherein said outer end portions are supported from said inner ends for adjusted extension and retraction relative thereto.

8. The assembly of claim 7 wherein said support members comprise support wheels.

9. The assembly of claim 5 wherein said one side of said standard includes engine block mounting means thereon spaced below said boom and against which the bell housing end of an automobile engine block may be biased for bolting thereto when said free end portion of said boom is retracted relative to said base end portion and said engine block is elevated by said tension member to a position closely spaced below said boom, said mounting means being supported from said one side of said standard for adjusted angular displacement relative to said standard about a horizontal axis generally normal to said one side.

* * * * *